US005377993A

United States Patent [19]

Josephs

[11] Patent Number: 5,377,993

[45] Date of Patent: Jan. 3, 1995

[54] WAGERING GAME

[76] Inventor: Ronald H. Josephs, 4122 Clarinda Dr., Tarzana, Calif. 91356

[21] Appl. No.: 217,415

[22] Filed: Mar. 4, 1994

[51] Int. Cl.[6] ..... A63F 1/00

[52] U.S. Cl. ..... 273/292; 273/85 CP

[58] Field of Search ..... 273/292, 274, 309, 85 CP

[56] References Cited

U.S. PATENT DOCUMENTS 5,013,049 5/1991 Tomaszewski ..... 273/292
5,019,973 5/1991 Wilcox et al. ..... 273/85 CP
5,255,915 10/1993 Miller ..... 273/85 CP
5,265,882 11/1993 Malek ..... 273/292

*Primary Examiner*—Benjamin H. Layno
*Attorney, Agent, or Firm*—Timothy T. Tyson; Joseph A. Compton

[57] ABSTRACT

A modified Twenty-One wagering game is provided. The game offers a wagering option (42) in which a player can increase his wager in advantageous situations. These situations not only envision a Twenty-One payoff but a payoff in accordance with a poker hand formed with certain ones of the player's and dealer's hands and a predetermined poker hand schedule (66).

18 Claims, 4 Drawing Sheets

| POKER HAND PAYOFF SCHEDULE | |
|---|---|
| THREE OF A KIND | 2 TO 1 |
| FOUR OF A KIND | 25 TO 1 |
| STRAIGHT | 4 TO 1 |
| FLUSH | 4 TO 1 |
| STRAIGHT FLUSH | 10 TO 1 |
| ROYAL FLUSH | 100 TO 1 |

WAGERING GAME

FIELD OF THE INVENTION

The present invention relates generally to card games and more particularly to the card game of Twenty-One.

BACKGROUND OF THE INVENTION

Conventional rules of the card game of Twenty-One (Black Jack) are well known. For example, see Scarne's New Complete Guide to Gambling, John Scarne, Harper & Row, New York, 1973, Scarne's Encyclopedia of Games, John Scarne, Harper & Row, New York, 1973, Hoyle's Modern Encyclopedia of Card Games, Gibson, W., Doubleday and Company, New York and Official Rules of Card Games, Albert H. Morehead, Fawcett Crest, N.Y., 1990.

The wagering game art in replete with card game methods and apparatus including those disclosed in U.S. Pat. Nos. Des. 89,034; Des. 198,632; 1,599,390; 4,648,604; 4,836,553; 4,861,041; 5,013,049; 5,019,973; 5,022,653; 5,042,818; 5,067,724; 5,072,946; 5,098,107; 5,042,818; 5,067,724; 5,072,946; 5,098,107; 5,100,137; 5,154,429; 5,167,413; 5,174,579; 5,251,897; and 5,265,882.

SUMMARY OF THE INVENTION

The present invention is directed to a modified Twenty-One game which is characterized by the steps of distributing initial cards to a player and a dealer and providing additional cards only to the dealer if required by conventional Twenty-One play. The game is further characterized by the steps of forming a combined poker hand of the player's initial cards and predetermined ones of the dealer's cards and comparing, if the player is the Twenty-One winner, the combined poker hand with a set of predetermined poker hands. Finally, the game is characterized by the steps of disbursing, if the combined poker hand is not one of the poker hand set, a payoff to the player in accordance with conventional Twenty-One play and disbursing, if the combined poker hand is one of the poker hand set, a payoff to the player in accordance with a predetermined poker hand payoff schedule.

In a preferred embodiment, the providing step is preceded by the step of offering the player, if his initial cards do not total twenty one, the option of adding a second wager to the first wager.

Therefore, embodiments of the invention offer the option of increasing wagers in advantageous situations but exercising this option to increase winnings requires player judgement and skill.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
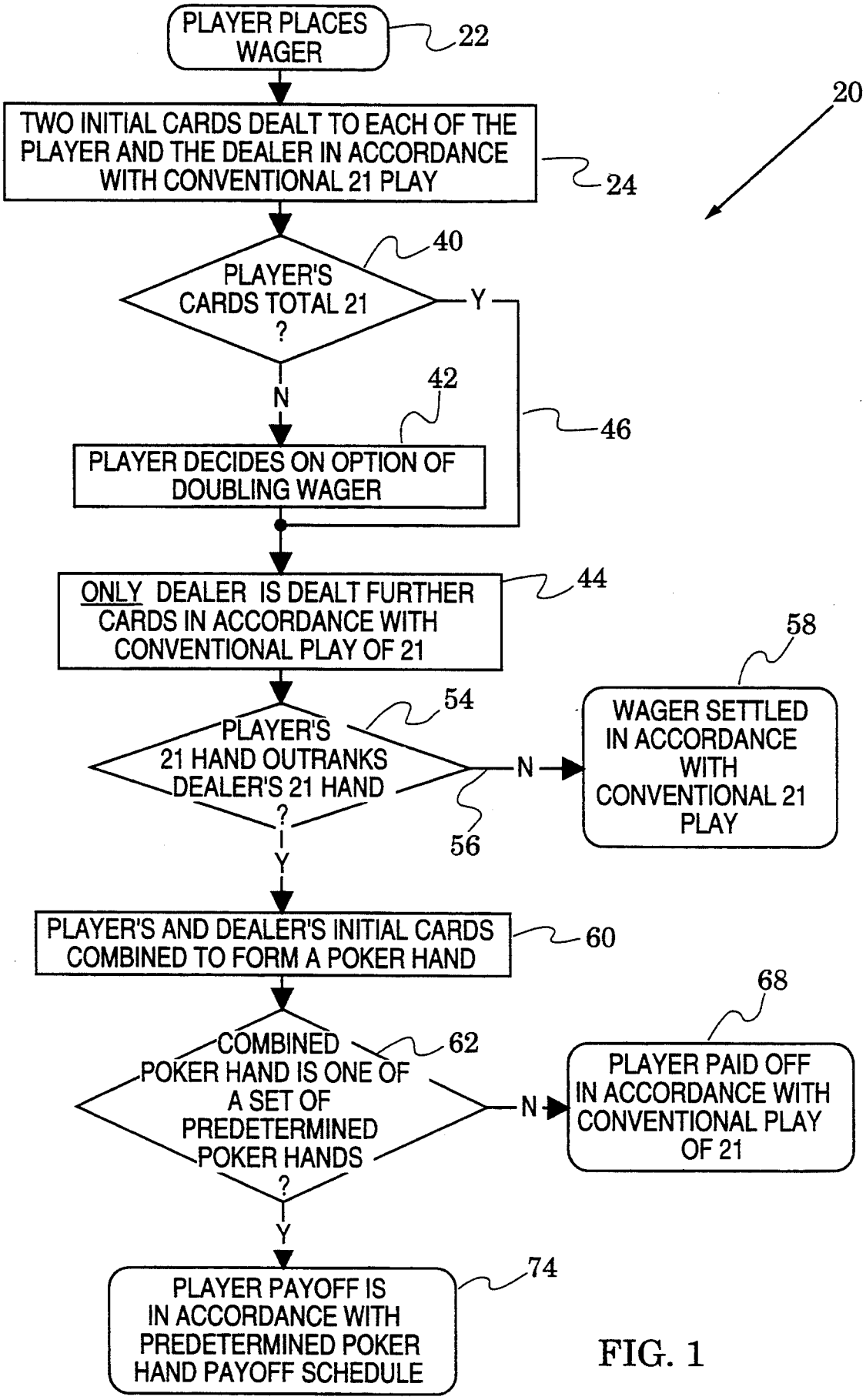
FIG. 1 is a flow diagram illustrating steps of a preferred method embodiment in accordance with the present invention.

FIG. 1 is a flowchart 20 illustrating steps in a preferred game embodiment in accordance with the present invention. The embodiment is directed to a modified Twenty-One game which reduces a player's odds of obtaining a winning hand in accordance with conventional Twenty-One rules. In compensation, the player is offered an option in which an initial wager may be increased. The player's decision on this option is made in the context of knowledge of certain initial cards, their effect on the probability of obtaining a winning Twenty-One hand and their effect on the probability of forming a winning poker hand. The poker hand is formed with certain combined cards of the player and the dealer and is awarded in accordance with a predetermined schedule. This option increases player participation in the game with consequent enhancement of game interest and enjoyment.

Attention is now initially directed to FIGS. 1 and 2 for a detailed description of a preferred game embodiment. For clarity of illustration, the flow chart 20 of FIG. 1 is directed to play between a dealer and a single player but it should be obvious that steps of the flow chart 20 may be practiced by each of a plurality of players who are playing in association with a dealer.

Figure 2B:
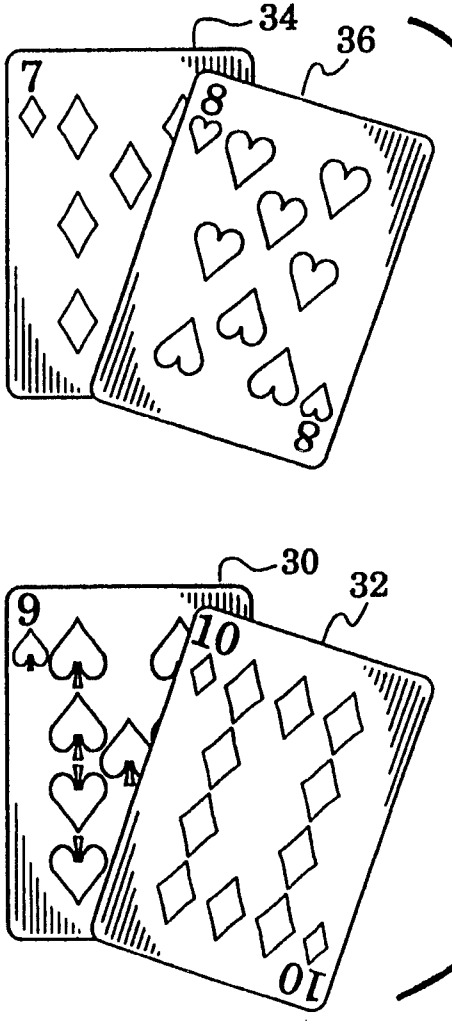
FIG. 2B illustrates exemplary dealer and player initial cards after a player decision on a wagering option in accordance with the flowchart of FIG. 1.
Figure 2A:
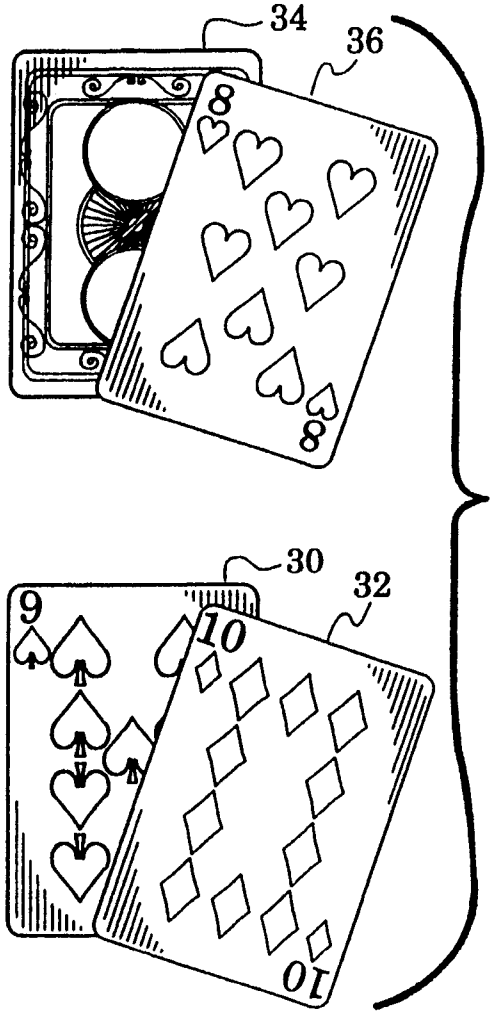
FIG. 2A illustrates exemplary initial cards distributed to a dealer and a player in accordance with the flowchart of FIG. 1.

The game begins with the terminator 22 where the player places an initial wager. In process 24, two initial cards are dealt to each of the player and the dealer in accordance with conventional Twenty-One play, i.e., the player's initial cards are dealt face up while one of the dealer's initial cards is dealt face up and the other is dealt face down. In an exemplary game, these initial cards are illustrated in FIG. 2A where the player has been dealt the initial cards 30, 32 and the dealer has dealt himself a face down initial card 34 and a face up initial card 36.

In test 40 of the flow chart 20, it is determined if the player's initial cards total twenty one. If they do not, the game proceeds to process 42 where the player decides whether to exercise an option to increase his initial wager by placing a second wager. In a preferred embodiment of the invention, the second wager equals the first wager, i.e., the player can choose to double his initial wager. The player's decision on this option is based on his knowledge of his initial cards 30, 32 and the dealer's face up initial card 36 as shown in FIG. 2A. After this option is exercised or refused, the game proceeds to process 44. Alternatively, if the player's initial cards total twenty one, the game proceeds directly from test 40 to process 44 along path 46, i.e., the player is restricted to his initial wager.

As shown in process 44, only the dealer is supplied with additional cards in accordance with conventional Twenty-One play. Thus, in accordance with an important feature of the invention, the player is denied additional cards and must "stick" with his initial cards. Since the player cannot receive further cards, the dealer in accordance with conventional Twenty-One rules, now exposes his face down card 34 so that all initial cards are visible to the player as shown in FIG. 2B. The exemplary dealer initial card 34 is seen to be a seven.

Conventional rules of Twenty-One requires the dealer to take additional cards until his total equals or exceeds a predetermined count. This count varies with different Twenty-One variations but seventeen is a typical count. In accordance with this version of the count, the dealer, having a total of fifteen, takes a first additional card 50 which turns out to be a three as shown in the exemplary hand of FIG. 2C.

Since the dealer's total is now eighteen, no further additional cards are dealt to the dealer and the flow chart 20 proceeds to test 54 which asks if the player's Twenty-One hand outranks the dealer's. If the answer is no, i.e., the dealer wins or the hand is a "push" (tie), the game moves along path 56 to terminator 58 where the player's wager (made in terminator 22) is settled in accordance with conventional Twenty-One rules. Accordingly, the player's wager goes to the dealer (or the house) if the dealer's hand outranks the player's hand and is returned to the player if the dealer's hand and the player's hand are of equal rank. This action terminates the play of one game hand if the player's hand does not outrank the dealer's hand.

If the answer to test 54 is yes, the game proceeds to process 60 where, in accordance with another feature of the invention, a poker hand is formed by combining the initial cards of the dealer and the player. In the instant embodiment of the invention, this will be a four card poker hand. This combined hand is then compared in test 62 with a predetermined set of poker hands. An exemplary predetermined poker hand set 64 is shown in the schedule 66 of FIG. 3 to include the poker hands of three of a kind, four of a kind, straight, flush, straight flush and royal flush and corresponding payoffs 67 relative to the player's wager.

If the answer to test 62 is no, the game passes to terminator 68 in which the player receives a payoff in accordance with conventional Twenty-One play, i.e., the player is paid an amount equal to his wager (in addition to retaining his wager).

Figure 3:
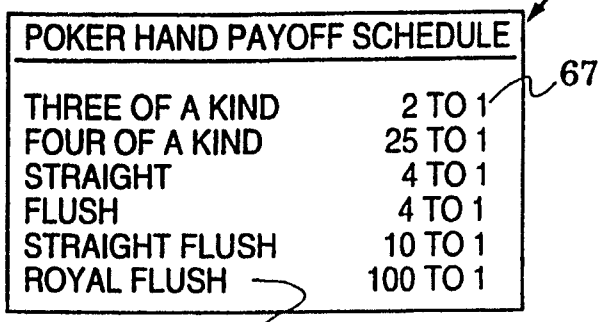
FIG. 3 illustrates an exemplary poker hand payoff schedule.
Figure 2D:
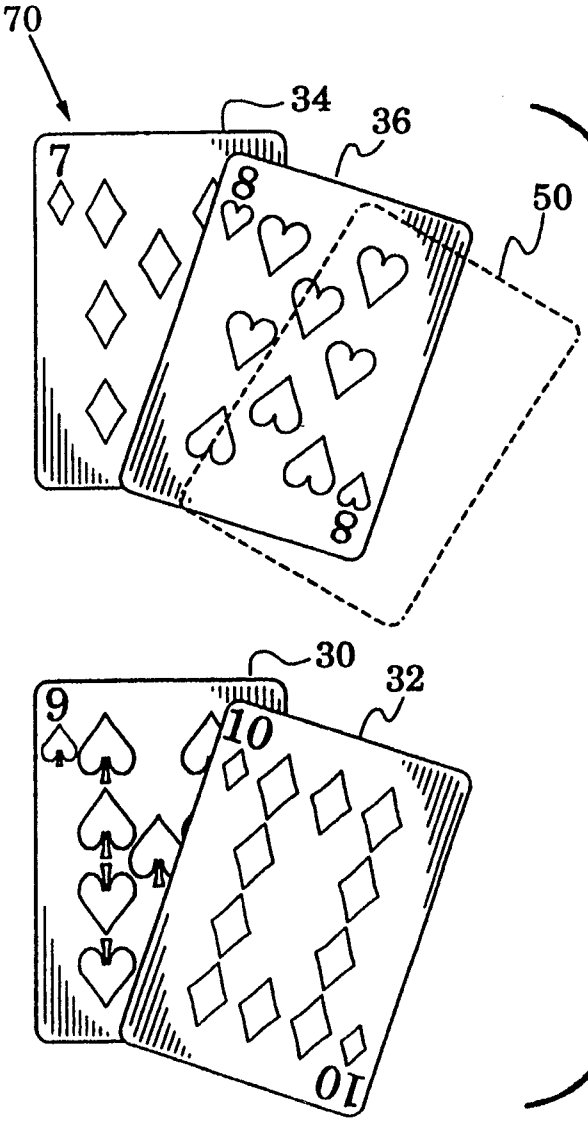
FIG. 2D illustrates an exemplary poker hand formed in accordance with the flowchart of FIG. 1.
Figure 2C:
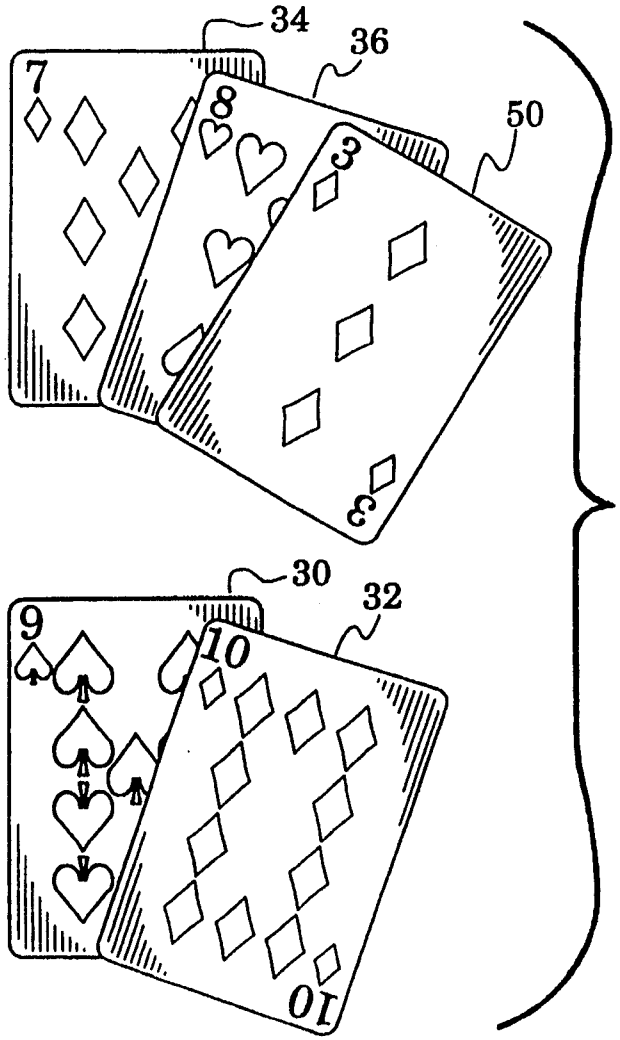
FIG. 2C illustrates an exemplary additional card provided to the dealer in accordance with the flowchart of FIG. 1.

If the answer to test 62 is yes, the player's wager is paid off in accordance with a predetermined poker hand payoff schedule, e.g., the exemplary poker hand payoff schedule 66 of FIG. 3. In the exemplary game hand shown in FIGS. 2, the combined poker hand 70 is shown in FIG. 2D to consist of the dealer's initial cards 34, 36 and the player's initial cards 30, 32. The dealer's additional card 50 is shown in broken lines to indicate it is not part of the combined poker hand 70. The exemplary combined poker hand 70 is a 7-8-9-10 straight which is one of the hands in the schedule 66. Thus, in accordance with terminator 76 and the exemplary schedule 66, the player would be paid 4 to 1 relative to his wager (the initial wager of terminator 22 plus the added wager, if any, of process 42).

From the above description, it is seen that the player can win only if his Twenty-One hand outranks the dealer's Twenty-One hand. This feature is similar to conventional Twenty-One games. As opposed to conventional Twenty-One, however, the resulting win may take the form of a Twenty-One payoff or a poker hand payoff based on a combined hand formed of initial cards.

In practice, the game method illustrated in FIG. 1 limits the player to only two initial cards while supplying the dealer with initial cards and additional cards as required in accordance with conventional Twenty-One rules. This feature decreases the player's chances of winning the Twenty-One hand relative to conventional Twenty-One play. However, in accordance with another feature of the invention, the player is offered the option of increasing his wager based on his knowledge of his initial cards and the dealer's face up initial card.

Accordingly, in light of this knowledge a player has the option to increase his wager in situations he judges favorable and let the wager ride in other situations. This knowledge is judged in two ways. Firstly, the player is able to appraise his chances of having a Twenty-One hand superior to the dealer's final Twenty-One hand. Secondly, the player is able to appraise his chances of forming a poker hand that is one of those in a predetermined schedule of poker hands.

Obviously, if the visible cards offer little opportunity of ending up with the superior Twenty-One hand or little opportunity of forming a poker hand with the initial cards of the player and the dealer, the player has no incentive to increase his initial wager. The player would typically choose to play out this hand with his initial wager.

Conversely, if these three cards give promise of a superior Twenty-One hand or promise of a combined poker hand the player can take advantage of the situation by increasing his wager. Thus, the player can increase wagers in favorable situations and limit wagers in unfavorable ones. For example, the exemplary hand of FIG. 2A not only gives the player a superior Twenty-One hand (a count of nineteen) but evidences the possibility of a combined straight poker hand. In this case, a player may well decide to increase his wager because of the favorable situation.

It should be noted that in accordance with the invention, players are encouraged to appraise their situation and make judgements accordingly. However, it is not intended that a player can take advantage of a situation that requires no judgement or decision to effect a win. Hence, the direct path 46 past the process 42 of FIG. 1.

The probabilities associated with option 42 of FIG. 1 have been examined. In particular, the probability of a player win was calculated for each possible hand resulting from process 24 of FIG. 1, e.g., the exemplary hand of FIG. 2A. With these stored probabilities, the ratio of expected win/expected bet was then calculated for two cases; first, where the player never exercises the option 42 and second, where the player always exercises the option 42 in a favorable situation, i.e., each situation judged favorable by the calculated probabilities. As might be expected, the ratio was found to be higher in the second case which indicates that game methods in accordance with the invention reward a skilled player. These rewards and the increased involvement of the player in the game's outcome enhance the game's attractiveness to a player.

The above description referred to conventional Twenty-One rules. These conventional rules are well known, e.g., see Scarne's New Complete Guide to Gambling, John Scarne, Harper & Row, New York, 1973, Scarne's Encyclopedia of Games, John Scarne, Harper & Row, New York, 1973, Hoyle's Modern Encyclopedia of Card Games, Gibson, W., Doubleday and Company, New York and Official Rules of Card Games, Albert H. Morehead, Fawcett Crest, N.Y., 1990, the disclosures of which are hereby incorporated by reference.

The conventional rules, however, embrace rule variations. For example, the game of Twenty-One typically requires a dealer to take additional cards (in addition to the two initial cards) until his total equals or exceeds a predetermined count. Many conventional rules stipulate this count to be seventeen but other counts are also conventionally used. In one conventional variation, the dealer is required to take an additional card when his hand is a "soft 17", i.e., he has an Ace and other cards totalling six.

Conventional rule variations are also exemplified by the orientation of the player's initial cards (cards 30, 32 in FIG. 2A). In games involving a plurality of players, these cards are typically face down to deny any player the knowledge of the outstanding cards. Other conventional rules allow the initial cards to be face up. In games intended for a single player, e.g., computer games, there is no reason for them to be hidden.

These are but two examples of conventional rule variations. It should be understood that all such conventional variations are intended to be included by references herein to conventional Twenty-One rules.

Other preferred embodiments of the invention are directed to process 60 of FIG. 1. In the embodiment described above, the combined poker hand is formed of the player's and dealer's initial cards as shown in the combined hand 70 of FIG. 2D. In another preferred embodiment, the combined hand also includes the first, if any, additional card distributed to the dealer, e.g., card 50 of FIGS. 2C and 2D. Other functionally equivalent variations may be envisioned. Other preferred embodiments of the game may be formed by altering the payoffs 67 of FIG. 3.

Although a preferred embodiment of the invention has been described above with reference to playing cards and a live dealer, it should be understood that the teachings of the invention may also be practiced with dealer and card substitutes. That is, the teachings of the invention may be practiced against a dealer or the like, e.g., a programmed computer or other apparatus, and with playing cards or the like, e.g., symbols on the display of a computer or other apparatus.

Accordingly, the flow chart 20 has been implemented with software code instructions in Visual Basic language intended for control of a microprocessor of the Intel 80286 family whose general architecture, internal register structure and programming instruction set are well known in the art, e.g., see Microprocessors, Principles and Applications, Charles M. Gilmore, McGraw-Hill Publishing, New York, 1989, the disclosure of which is hereby incorporated by reference. Equivalent software instructions in the above or other languages intended for control of the above or other microprocessors can be written in a straightforward manner by those skilled in the art to implement the flow chart features of FIG. 1.

Figure 4:
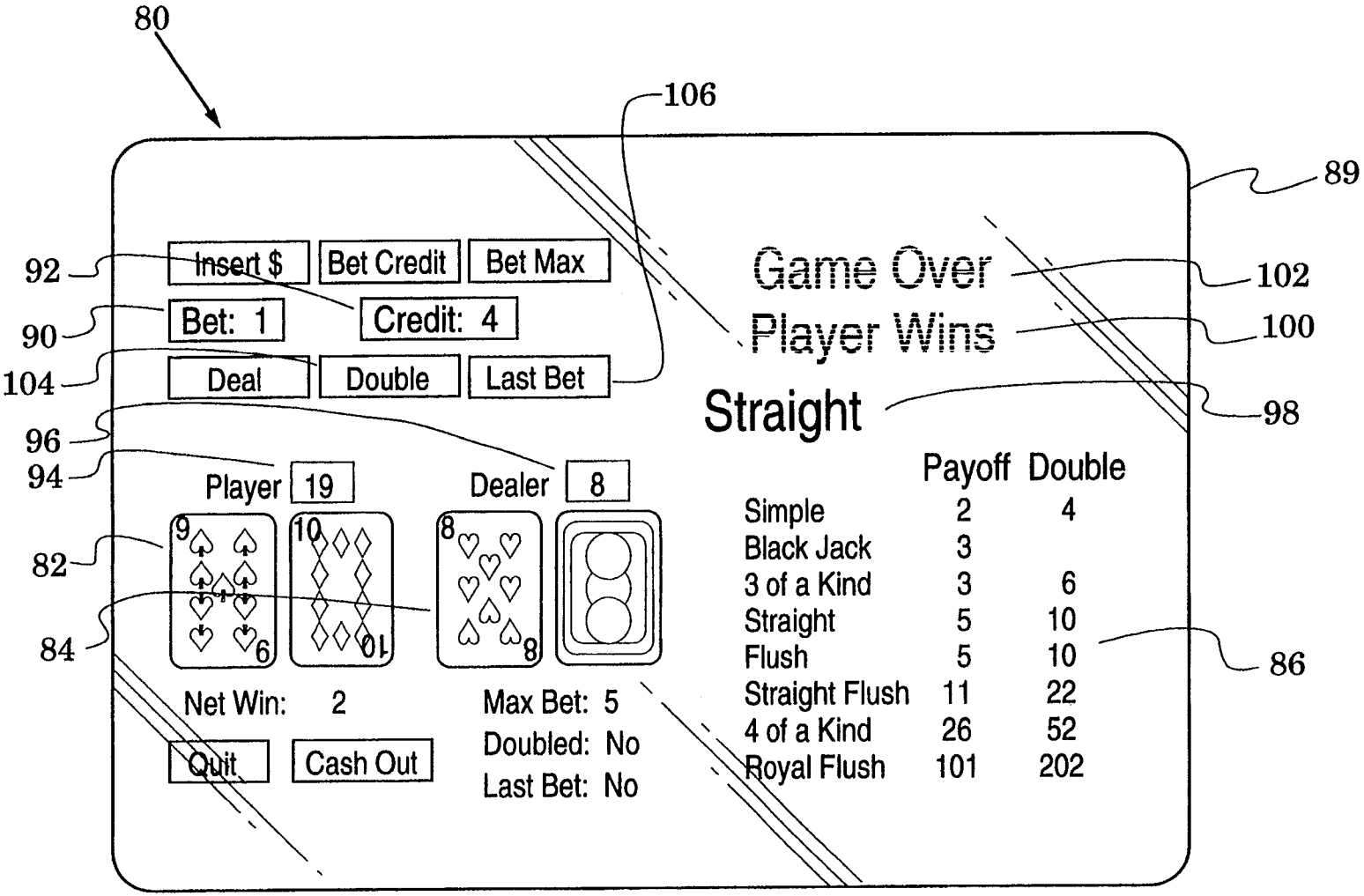
FIG. 4 illustrates an exemplary computer display in accordance with the flowchart of FIG. 1.

Various monitor representations of cards and/or a dealer can be envisioned and realized when practicing the invention on a computer or other apparatus. For example, the game may be practiced with the exemplary computer display 80 of FIG. 4 which displays the player's hand 82, the dealer's hand 84 and the predetermined poker hand payoff schedule 86 on a monitor 89. The player's current bet 90, available credit 92, current hand total 94, the dealer's current hand total 96 and the current possible poker hand 98 are also displayed. Windows are provided that light up to announce the winner 100 and the game status 102. Various controls are provided to allow the player to input his play decisions, e.g., a control 104 to double his wager and a control 106 to repeat the last wager. Various well known input devices may be used for these controls, e.g., mouse, light pen, push buttons.

From the foregoing it should now be recognized that embodiments of a modified Twenty-One game have been disclosed herein configured to offer a wagering option in which a player may increase his wager in advantageous situations. Methods in accordance with the present invention require player decisions which enhance player participation and interest in the game.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. A method for a player and a dealer to play a modified version of the game of Twenty-One with playing cards, comprising the steps of:

said player placing a first wager;

distributing two initial cards to said player and two initial cards to said dealer in accordance with conventional Twenty-One play;

providing, only to said dealer, additional cards if required in accordance with conventional Twenty-One play;

determining a winner or a push in accordance with conventional Twenty-One play;

forming, if said player is said winner, a combined poker hand of the player's initial cards and predetermined ones of the dealer's cards;

comparing, if said player is said winner, said combined poker hand with a set of predetermined poker hands;

disbursing, if said player is said winner and said combined poker hand is not one of said poker hand set, a payoff to said player in accordance with conventional Twenty-One play; and disbursing, if said player is said winner and said combined poker hand is one of said poker hand set, a payoff to said player in accordance with a predetermined poker hand payoff schedule.

2. The method of claim 1 wherein said providing step is preceded by the step of offering said player, if his initial cards do not total twenty one, the option of adding a second wager to said first wager.

3. The method of claim 2 wherein said second wager equals said first wager.

4. The method of claim 1 wherein said predetermined ones of the dealer's cards consist only of the dealer's initial cards.

5. The method of claim 1 wherein said predetermined ones of the dealer's cards consist of the dealer's initial cards and the first one, if there is a first one, of the dealer's additional cards.

6. The method of claim 1 wherein said predetermined poker hand payoff schedule includes the following predetermined poker hand set and payoffs corresponding to hands thereof:

| | |
|---|---|
| three of a kind | 2 to 1, |
| four of a kind | 25 to 1, |
| Straight | 4 to 1, |
| Flush | 4 to 1, |
| Straight Flush | 10 to 1, and |

-continued

| | |
|---|---|
| Royal Flush | 100 to 1. |

7. A method for enabling a player to play a modified version of the game of Twenty-One against a dealer or a representation thereof using computer and a display device, said method comprising the steps of:

recording with said computer a first wager from said player;

generating and displaying on said display device, representations of two initial player cards and two initial dealer cards in accordance with conventional Twenty-One play;

providing and displaying on said display device, representations of additional dealer cards if required in accordance with conventional Twenty-One play;

determining a winner or a push in accordance with conventional Twenty-One play;

forming, if said player is said winner, a combined poker hand consisting of the represented initial player cards and predetermined ones of the represented dealer cards;

comparing, if said player is said winner, said combined poker hand with a set of predetermined poker hands;

awarding, if said player is said winner and said combined poker hand is not one of said poker hand set, a payoff to said player in accordance with conventional Twenty-One play; and awarding, if said player is said winner and said combined poker hand is one of said poker hand set, a payoff to said player in accordance with a predetermined poker hand payoff schedule.

8. The method of claim 7 wherein said providing and displaying step is preceded by the step of offering said player, if his represented initial cards do not total twenty one, the option of recording with said computer a second wager which is added to said first wager.

9. The method of claim 8 wherein said second wager equals said first wager.

10. The method of claim 7 wherein said predetermined ones of the represented dealer cards consist only of the represented initial dealer cards.

11. The method of claim 7 wherein said predetermined ones of the represented dealer cards consist of the represented initial dealer cards and the first one, if there is a first one, of the represented additional dealer cards.

12. The method of claim 7 wherein said predetermined poker hand payoff schedule includes the following predetermined poker hand set and payoffs corresponding to hands thereof:

| | |
|---|---|
| three of a kind | 2 to 1, |
| four of a kind | 25 to 1, |
| Straight | 4 to 1, |
| Flush | 4 to 1, |
| Straight Flush | 10 to 1, and |
| Royal Flush | 100 to 1. |

13. Apparatus enabling a player to play a modified version of the game of Twenty-One against a dealer or a representation thereof, comprising:

at least one input device;

a computer responsive to said input device;

a display device responsive to said computer;

said input device configured to record with said computer a first wager from said player;

said computer programmed to respond to the recording of said wager by generating and displaying on said display device representations of two initial player cards and two initial dealer cards in accordance with conventional Twenty-One play;

said computer also programmed to provide and display on said display device additional dealer cards if required in accordance with conventional Twenty-One play; and said computer further programmed to perform the steps of:

a) determining a winner or a push in accordance with conventional Twenty-One play;

b) forming, if said player is said winner, a combined poker hand consisting of the represented initial player cards and predetermined ones of the represented dealer cards;

c) comparing, if said player is said winner, said combined poker hand with a set of predetermined poker hands;

d) awarding, if said player is said winner and said combined poker hand is not one of said poker hand set, a payoff to said player in accordance with conventional Twenty-One play; and e) awarding, if said player is said winner and said combined poker hand is one of said poker hand set, a payoff to said player in accordance with a predetermined poker hand payoff schedule.

14. The apparatus of claim 13 wherein said computer is further programmed to precede the displaying of said additional dealer cards with the step of offering said player, if his initial cards do not total twenty one, the option of recording an additional second wager with said input device.

15. The apparatus of claim 14 wherein said second wager equals said first wager.

16. The apparatus of claim 13 wherein said predetermined ones of the represented dealer cards consist only of the represented initial dealer cards.

17. The apparatus of claim 13 wherein said predetermined ones of the represented dealer cards consist of the represented initial dealer cards and the first one, if there is a first one, of the represented additional dealer card 18. The apparatus of claim 13 wherein said predetermined poker hand payoff schedule includes the following predetermined poker hand set and payoffs corresponding to hands thereof:

| | |
|---|---|
| three of a kind | 2 to 1, |
| four of a kind | 25 to 1, |
| Straight | 4 to 1, |
| Flush | 4 to 1, |
| Straight Flush | 10 to 1, and |
| Royal Flush | 100 to 1. |

* * * * *